US005967946A

United States Patent [19]

Beatty, Jr.

[11] Patent Number: 5,967,946

[45] Date of Patent: Oct. 19, 1999

[54] APPARATUS FOR CYCLING TRAINING

[76] Inventor: Alfred C. Beatty, Jr., 213 Second Ave., Broomall, Pa. 19008

[21] Appl. No.: 08/910,081

[22] Filed: Aug. 12, 1997

[51] Int. Cl.[6] ..... A63B 69/16

[52] U.S. Cl. ..... 482/61; 482/57; 434/61

[58] Field of Search ..... 482/66, 57, 61, 482/60, 63; 434/61

[56] References Cited

U.S. PATENT DOCUMENTS

| | | | |
|---|---|---|---|
| D. 273,882 | 5/1984 | Bryne | 482/61 X |
| 592,093 | 10/1897 | Law | 482/61 |
| 2,043,977 | 6/1936 | Back | 482/61 |
| 3,352,426 | 11/1967 | Carlson | 482/61 X |
| 3,866,908 | 2/1975 | Hangler | 482/61 |
| 4,466,797 | 8/1984 | Ray | 482/61 X |
| 4,938,475 | 7/1990 | Sargeant | 482/61 X |
| 4,955,600 | 9/1990 | Hoffenberg | 482/61 |
| 5,382,208 | 1/1995 | Hu | 482/61 X |

FOREIGN PATENT DOCUMENTS

| | | | |
|---|---|---|---|
| 2424747 | 11/1979 | France | 482/61 |
| 1697859-A1 | 12/1991 | U.S.S.R. | 482/57 |
| 2151562 | 7/1985 | United Kingdom | 482/61 |

*Primary Examiner*—Richard J. Apley
*Assistant Examiner*—William LaMarca
*Attorney, Agent, or Firm*—Dann, Dorfman, Herrell & Skillman, P.C.; Stephen H. Eland

[57] ABSTRACT

An exercise apparatus for facilitating single-leg cycling training is provided. The training device operates in connection with a bicycle mounted on a resistance trainer that supports the rear wheel of the bicycle. The device incorporates a single-leg trainer. The single-leg trainer includes a pair of vertically adjustable foot rests that are disposed in a spaced apart relation and are substantially longitudinally aligned with the pedals of the bicycle.

20 Claims, 2 Drawing Sheets

FIG. 2
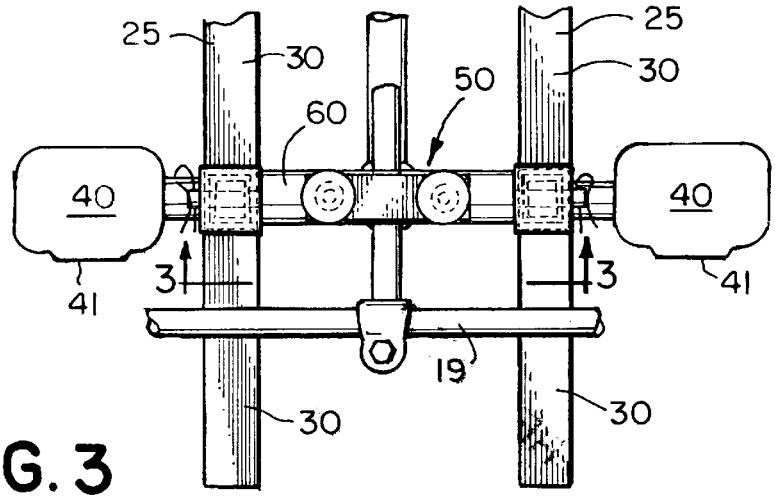
FIG. 3
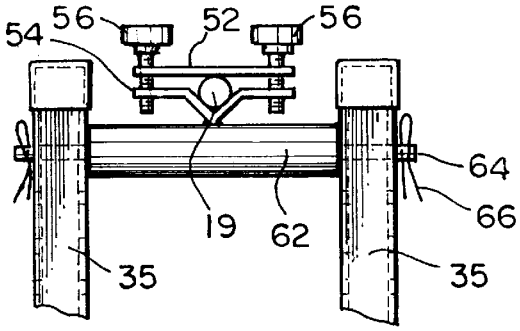
FIG. 4
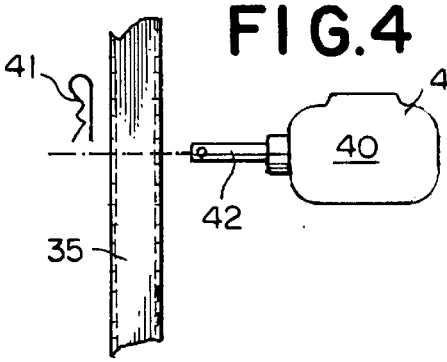
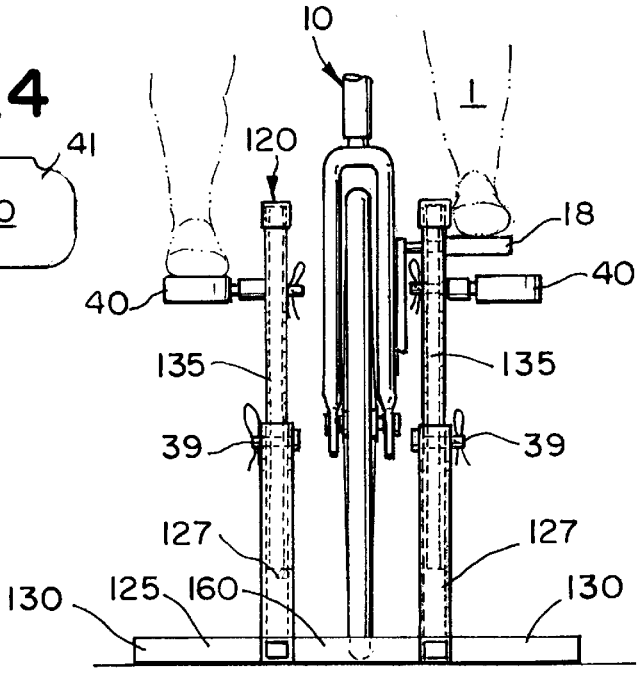
FIG. 5

APPARATUS FOR CYCLING TRAINING

FIELD OF THE INVENTION

The present invention relates to the field of exercise equipment. In particular, the present invention relates to an apparatus for cycling training operable in connection with a bicycle.

BACKGROUND OF THE INVENTION

The use of stationary bicycles for cycling training is well known in the art. A typical design incorporates a bicycle mounted on a training device that supports the rear wheel of the bicycle. Often, the rear wheel support provides some type of resistance when the rider pedals the bicycle. Frequently, riders desire to incorporate single-leg training into their training routine to target and develop leg-lifting muscles. For single-leg training, the rider removes a foot from one of the pedals and pedals the bicycle with one leg.

SUMMARY OF THE INVENTION

In accordance with the present invention, a cycling training device is provided. The device enables the rider to incorporate single-leg training into a normal training routine without significantly altering the rider's cycling form.

The training apparatus is operable in connection with a bicycle having a pair of pedals and a crank having two crank arms. Each pedal is connected to a distal end of one of the crank arms and each pedal defines a path of rotation as the crank is rotated around a crank axis. The training apparatus includes a frame comprising a pair of elongated vertical posts, laterally spaced apart from one another, and a pair of foot rests. Each foot rest is connected to one of the vertical posts so that each foot rest is forward of the crank and is substantially longitudinally aligned with one of the pedal paths of rotation.

BRIEF DESCRIPTION OF THE DRAWINGS

The foregoing summary as well as the following detailed description of the preferred embodiments of the present invention will be better understood when read in conjunction with the appended drawings, in which:

FIG. 2 is an enlarged fragmentary plan view of the apparatus shown in FIG. 1;

FIG. 3 is an enlarged fragmentary elevational view of the apparatus shown in FIG. 2, taken along line 3—3;

FIG. 4 is an enlarged fragmentary exploded elevational view of the apparatus shown in FIG. 1, illustrating the connection between one of the foot rests and one of the vertical posts; and FIG. 5 is a front elevational view of a second embodiment of an apparatus for cycling training, with the rider shown in phantom.

DETAILED DESCRIPTION OF THE PREFERRED EMBODIMENTS

Figure 1:
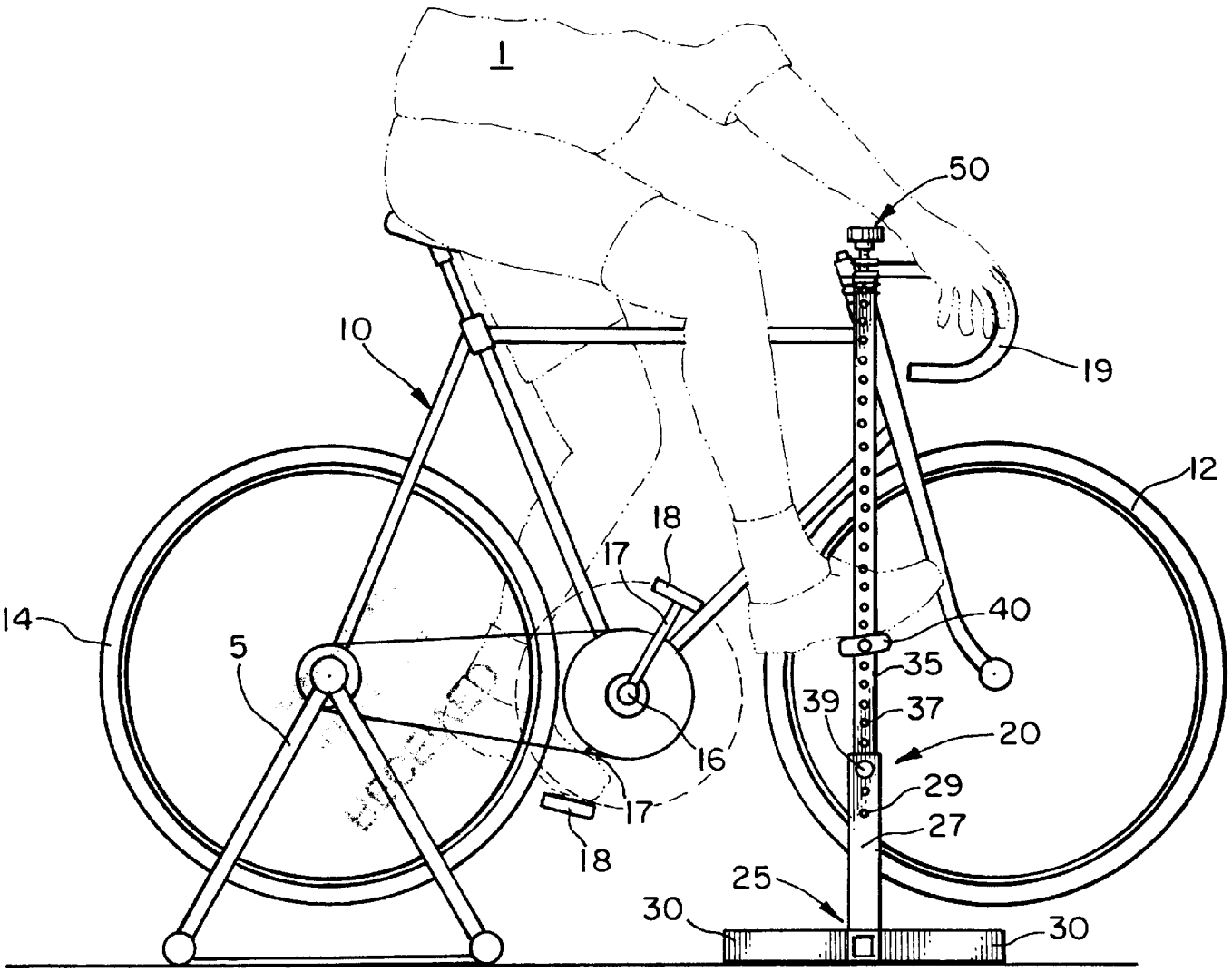
FIG. 1 is a side elevational view of an apparatus for cycling training according to the present invention with a rider shown in phantom.

Referring now to the drawings in general and to FIG. 1 specifically, an exercise apparatus for cycling training is illustrated. The apparatus includes a single-leg trainer 20 that supports the front wheel 12 of a bicycle 10. The rear wheel 14 of the bicycle 10 is supported by a rear support 5. Preferably the rear support 5 and the trainer 20 maintain the bicycle 10 in a level position raised several inches off of the ground. In addition, the rear support 5 is a typical resistance trainer, known in the art, that provides resistance as the rider 1 pedals the bicycle 10. During general training, the rider operates the device by pedalling the bicycle with both legs. To facilitate single-leg training, the operator places a leg on a foot rest 40 of the trainer 20 and pedals the bicycle 10 with one leg.

The bicycle includes front and rear wheels 12, 14, respectively. The rear wheel 14 is mounted on the rear support 5 and is mechanically coupled to a crank 16 that includes a pair of opposing crank arms 17. A pedal 18 is connected to the distal end of each of the crank arms. The crank 16 is rotatable about a crank axis, so that as the rider 1 pedals the bicycle, each pedal 18 defines a circular path of rotation about the crank axis.

Referring now to FIGS. 1–3, the single-leg trainer 20 is illustrated. The front support includes two vertical posts 35 that straddle the bicycle 10. Each vertical post 35 is removably connected to a base 25. Each base 25 includes a pair of horizontally elongated stabilizer arms 30 that distribute the load supported by the trainer 20. The arms 30 are transverse one another forming a generally t-shaped base. Each base 25 further includes a socket 27 that extends vertically upwardly from the horizontal arms 30. The vertical socket 27 is configured to receive one of the vertical posts 35. Each vertical post 35 telescopes within one of the sockets 27 so that the overall height of the trainer 20 can be adjusted. A plurality of aligned vertically spaced adjustment holes 37 in each socket 27 and vertical post 35, allow the height of the trainer 20 to be incrementally adjusted. To set the height of the trainer 20, the vertical post 35 is inserted into the socket 27 until one of the adjustment holes in the vertical post aligns with one of the holes in the socket 27. A retaining pin 39 is then inserted into the aligned holes through the socket and the vertical post. A cotter pin may be used to maintain the retaining pin 39 in place.

The two vertical posts 35 are connected to one another by a cross-bar 60. In the present instance, the cross-bar is releasably connected to both vertical posts 35 so that the height of the cross bar can be adjusted. The cross-bar 60 includes a body 62 that acts as a spacer between the two vertical posts 35. In addition, each end of the cross-bar is smaller in diameter than the body 62, forming connecting pins 64 that cooperate with the adjustment holes 37 in each of the vertical posts 35. To connect the vertical posts, each connecting pin 64 is inserted into an adjustment hole 37 in each of the vertical posts. A pair of cotter pins 66 retain the connecting rod in place on the vertical posts.

The bike 10 is mounted on the trainer 20 so that the front wheel 12 is raised off of the ground. Preferably, the trainer 20 supports the front wheel 12 so that the front and rear wheels are approximately the same height off of the ground. The bicycle 10 is mounted to the front support 20 via a mounting clamp 50 rigidly connected to the outer sleeve 62 of the cross-bar 60.

The mounting clamp 50 clamps on to the stem of the bicycle handlebars 19 as follows. The mounting clamp 50 includes an upper jaw 52 and a lower jaw 54. The upper jaw 52 is a generally flat metallic plate. The lower jaw 54 includes a V-groove for receiving the stem of the handlebars 19. A pair of tightening knobs 56 threadedly engage the upper and lower jaws 52, 54 to tighten and release the mounting clamp. Turning the knobs in one direction advances the upper jaw 52 toward the lower jaw 54 to tighten the clamp; turning the tightening knobs in the opposite direction draws the upper jaw away from the lower jaw to release the mounting clamp.

The height at which the front support maintains the front wheel of the bicycle can be adjusted in one of two ways. As previously discussed, the overall height of the vertical posts 35 can be adjusted by telescoping the vertical posts within the sockets 27. In addition, because the clamp 50 is mounted on the cross-bar 60, adjusting the height of the cross-bar 60 adjusts the height of the bicycle off the floor.

The trainer 20 includes a pair of vertically adjustable foot rests 40. Each foot rest 40 is independently adjustable on one of the vertical posts 35. The foot rests 40 are generally planar, having a tongue 41 projecting forward from the front edge of each respective foot rest. The tongue 41 is coplanar with the body of the associated foot rest 40 and is configured to cooperate with clipless bindings that are used on many cycling shoes. Preferably, the foot rests 40 are coated with a non-slip material to provide increased traction. The increased traction decreases the likelihood that the rider's foot will slip off the foot rest if the rider is wearing shoes having recessed clipless bindings or shoes without bindings. Each foot rest 40 includes a post 42 that is adapted to register within one of the adjustment holes 37. A cotter pin 44 maintains the foot rest 40 in place so that the foot rest is rotatably connected to the vertical post 35.

A second embodiment of the training device is illustrated in FIG. 5, in which like reference numerals refer to like components in the first embodiment described above. In the second embodiment, the training device 120 straddles the bicycle 10, but the bicycle is not connected to the trainer. The trainer 120 includes a base 125 having a plurality of horizontal stabilizing arms 130. The base 125 includes a pair of vertical sockets 127 spaced apart from one another. As in the first embodiment, each socket 127 is configured to receive a vertical post 135 in telescoping relation. A cross-bar 160 rigidly connects the two vertical posts 127. The vertical posts 135 are vertically adjustable independent of one another as in the first embodiment. In addition, an incrementally vertically adjustable foot rest 40 is releasably connected to each of the vertical posts 135 in a manner similar to the first embodiment described above.

As described above, each pedal 18 follows a path of rotation about the crank axis as the crank of the bicycle rotates about the crank axis. Because the pedals 18 are laterally spaced apart, the respective paths of rotation for each pedal are also laterally spaced. In each of the embodiments described above, the foot rests 40 are spaced apart so that each foot rest is substantially longitudinally aligned with one of the paths of rotation. In other words, as can be seen most clearly in FIG. 5, each pedal 18 is aligned with a foot rest 40 so that the rider can simply move his or her foot forward instead of sideways, to facilitate single-leg training.

Operation of the apparatus is as follows. The rear support 5 support the rear wheel off of the ground, so that the bicycle can be operated as a stationary bicycle. Each pedal 18 includes some type of binding or toe-hold so that the rider's feet are releasably connected to the pedals. During general training, the rider utilizes both legs to pedal the bicycle to drive the rear wheel. In order to accomplish single-leg training, the rider releases one foot from one of the pedals 18 and moves the foot forward onto one of the foot rests 40. Because the foot rests 40 are substantially longitudinally aligned with the paths of rotation of the pedals 18, the rider need not move the leg significantly laterally. In this way, the rider is able to maintain a more natural riding position during single-leg training. In addition, preferably, when a pedal 18 is in its forward most position (i.e. the position along the path of rotation at which the pedal is farthest to the right from the perspective of FIG. 1), the pedal is adjacent the corresponding foot rest 40, with a clearance space between the pedal and the foot rest sufficient to allow the rider to place a foot on the foot rest without interfering with the pedal as the pedal travels along the path of rotation.

The terms and expressions which have been employed are used as terms of description and not of limitation. There is no intention in the use of such terms and expressions of excluding any equivalents of the features shown and described or portions thereof. It is recognized, however, that various modifications are possible within the scope of the invention as claimed.

What is claimed is:

1. An apparatus for supporting a user during cycling training comprising:

a bicycle, comprising:

a wheel;

a crank rotatable about a crank axis, comprising a pair of crank arms, wherein rotation of the crank causes the wheel to rotate;

a pair of pedals each connected to a distal end of one of the crank arms, wherein each pedal defines a path of rotation as the crank is rotated about the crank axis;

a frame straddling the bicycle comprising a pair of laterally spaced apart vertical posts; and a substantially planar pair of foot rests for supporting each foot of the user, each foot rest being connected to one of the vertical posts so that each foot rest is forward of the crank and is substantially longitudinally aligned in the same place with one of the pedal paths of rotation;

a locking element attached to each foot rest for engaging and retaining each foot of the user on each foot rest.

2. The apparatus of claim 1, wherein each pedal has a forward-most position along the respective path of rotation and each foot rest is located forward of one of the pedal forward-most positions and adjacent one of the pedal forward-most positions.

3. The apparatus of claim 1, wherein each foot rest is vertically adjustable relative to the bicycle.

4. The apparatus of claim 1, wherein each vertical post is vertically adjustable relative to the bicycle.

5. The apparatus of claim 1, wherein each foot rest is removably connectable with one of the vertical posts.

6. The apparatus of claim 1, wherein each post comprises a plurality of vertically spaced apart sockets for removably receiving one of the foot rests.

7. The apparatus of claim 1, wherein the frame is removably connected to the bicycle.

8. The apparatus of claim 1, comprising a bar connected the two vertical posts.

9. The apparatus of claim 8, wherein the bar is removably connected to the two vertical posts.

10. An apparatus for during cycling training operable in connection with a bicycle operable by a user having a pair of pedals and a crank having two crank arms, each pedal being connected to distal end of one of the crank arms, wherein each pedal defines a path of rotation as the crank is rotated about a crank axis, the apparatus comprising:

a frame comprising a pair of elongated vertical posts, laterally spaced apart from one another; and a pair of substantially planar foot rests, each foot rest being connected to one of the vertical posts so that each foot rest is forward of the crank and is substantially longitudinally aligned, in the same plane with one of the pedal paths of rotation;

a locking element attached to each foot rest for engaging and retaining each foot of the user on each foot rest.

11. The apparatus of claim 10, wherein each pedal has a forward-most position along the respective path of rotation and each foot rest is located forward of one of the pedal forward-most positions and adjacent one of the pedal forward-most positions.

12. The apparatus of claim 10, wherein each foot rest is vertically adjustable.

13. The apparatus of claim 10, wherein each vertical post is vertically adjustable.

14. The apparatus of claim 10, wherein each foot rest is removably connectable with one of the vertical posts.

15. The apparatus of claim 10, wherein each post comprises a plurality of vertically spaced apart sockets for removably receiving one of the foot rests.

16. The apparatus of claim 10, wherein the frame is removably connectable with the bicycle.

17. The apparatus of claim 10, comprising a bar connecting the two vertical posts.

18. The apparatus of claim 17, wherein the bar is removably connected to the two vertical posts.

19. The apparatus of claim 1 wherein each footrest has a forward edge, and the locking element comprises a tongue projecting forwardly from the forward edge.

20. The apparatus of claim 10 wherein each footrest has a forward edge, and the locking element comprises a tongue projecting forwardly from the forward edge.

* * * * *